US007497061B1

(12) United States Patent
Isaacs

(10) Patent No.: US 7,497,061 B1
(45) Date of Patent: Mar. 3, 2009

(54) SYSTEM TO PREVENT OIL CANNING IN METAL ROOFING AND SIDING

(76) Inventor: Delbert Isaacs, 104 Barberry La., Berea, KY (US) 40403

( * ) Notice: Subject to any disclaimer, the term of this patent is extended or adjusted under 35 U.S.C. 154(b) by 563 days.

(21) Appl. No.: 11/107,767

(22) Filed: Apr. 15, 2005

Related U.S. Application Data

(60) Provisional application No. 60/563,417, filed on Apr. 19, 2004.

(51) Int. Cl.
*E04C 2/54* (2006.01)

(52) U.S. Cl. ..... 52/786.13; 52/302.3; 52/302.4

(58) Field of Classification Search ..... 52/95, 52/198, 302.3, 302.4, 786.13, 536–537
See application file for complete search history.

(56) References Cited

U.S. PATENT DOCUMENTS 332,720 A 12/1885 Lindsley
2,766,861 A 10/1956 Abramson
3,394,524 A * 7/1968 Howarth ..... 52/588.1
4,104,841 A * 8/1978 Naz ..... 52/519
4,736,561 A * 4/1988 Lehr et al. ..... 52/410
5,388,381 A 2/1995 Bilinski et al.
5,524,409 A 6/1996 Kaiser
5,596,847 A * 1/1997 Stephenson ..... 52/198
5,605,371 A 2/1997 Borchelt et al.
5,737,894 A * 4/1998 Simpson et al. ..... 52/520
5,839,247 A 11/1998 Beck
5,860,259 A * 1/1999 Laska ..... 52/302.3
6,401,412 B1 * 6/2002 Cooper ..... 52/302.1
6,594,965 B2 * 7/2003 Coulton ..... 52/302.1

* cited by examiner

*Primary Examiner*—Richard E Chilcot, Jr.
*Assistant Examiner*—Chi Q Nguyen
(74) *Attorney, Agent, or Firm*—Camoriano and Associates; Theresa Fritz Camoriano

(57) ABSTRACT

A device and method for securing a substantially flat sheet of metal (such as metal roofing or siding) to a substrate in a manner which avoids or reduces oil canning. A longitudinal spacer is installed between the metal surface and the substrate so as to induce a bowing or camber of the sheet of metal.

13 Claims, 6 Drawing Sheets

SYSTEM TO PREVENT OIL CANNING IN METAL ROOFING AND SIDING

This application claims priority from U.S. Provisional Application Ser. No. 60/563,417 filed Apr. 19, 2004, which is hereby incorporated herein by reference.

BACKGROUND

The present invention relates to a device and a method to prevent oil canning of flat metal surfaces, such as metal roofs and siding. Oil canning is a well-known phenomenon in metal roofing and siding. It is a rippling or buckling of the sheet metal material and is found to some extent in most installations. It detracts from the aesthetic appearance of the roofing and siding.

SUMMARY

The present invention provides a device and a method for substantially reducing or eliminating the oil canning phenomenon in metal roofing and siding.

In one embodiment, a standard roofing or siding panel can be used. In order to prevent the oil canning, a spacer is placed between the metal panel and the substrate. This spacer applies a "bow" or camber to the flat surface, pre-stressing or pre-stretching the panel. The spacer is preferably made from a material which is softer than both the metal panel and the substrate over which the panel is installed. This allows the spacer material to "give" when a person walks on the flat panel, so there is no permanent kinking of the panel.

DESCRIPTION OF THE PREFERRED EMBODIMENTS

Figure 1:
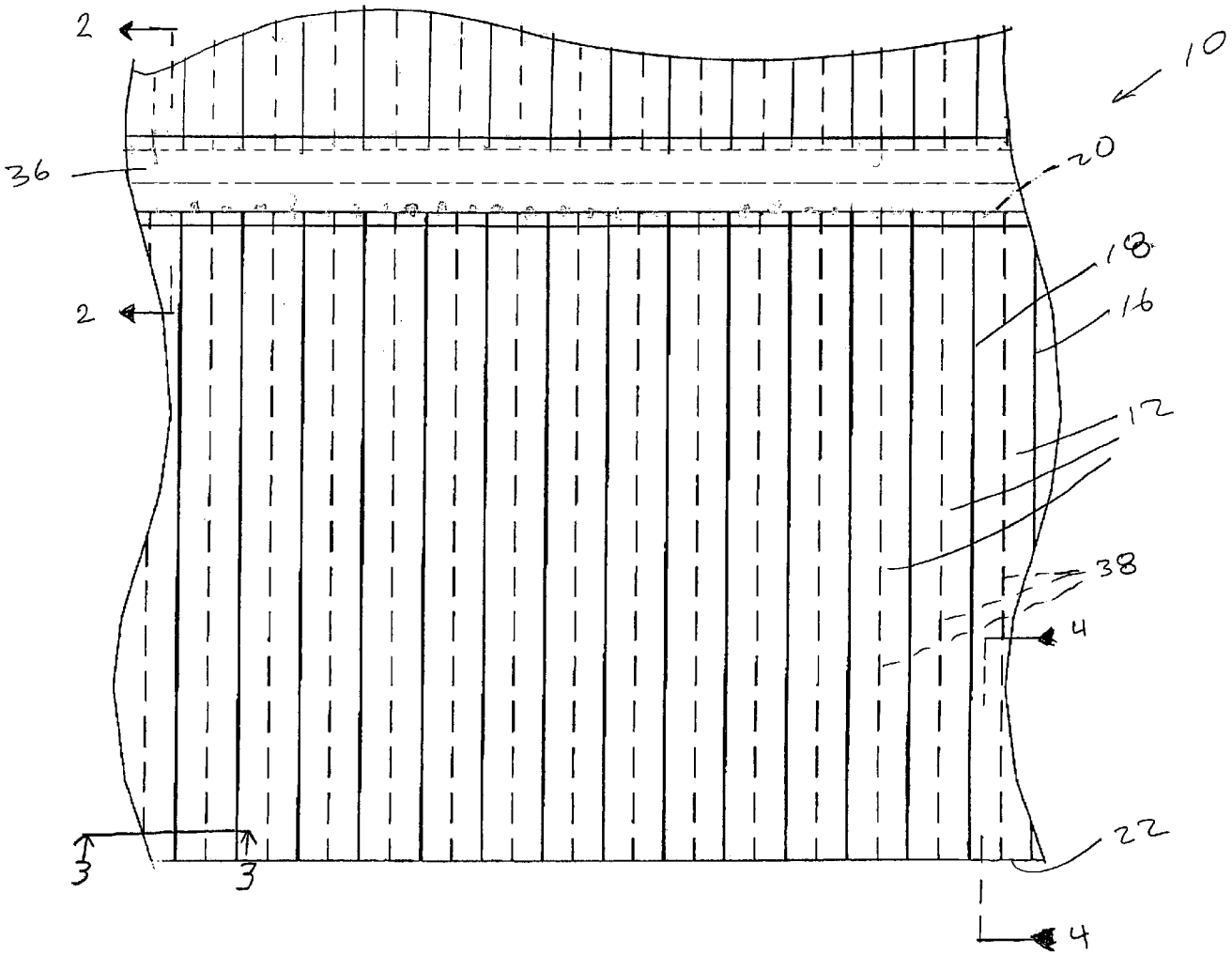
FIG. 1 is a broken away plan view of a metal roof made in accordance with the present invention.
Figures 5, 6:
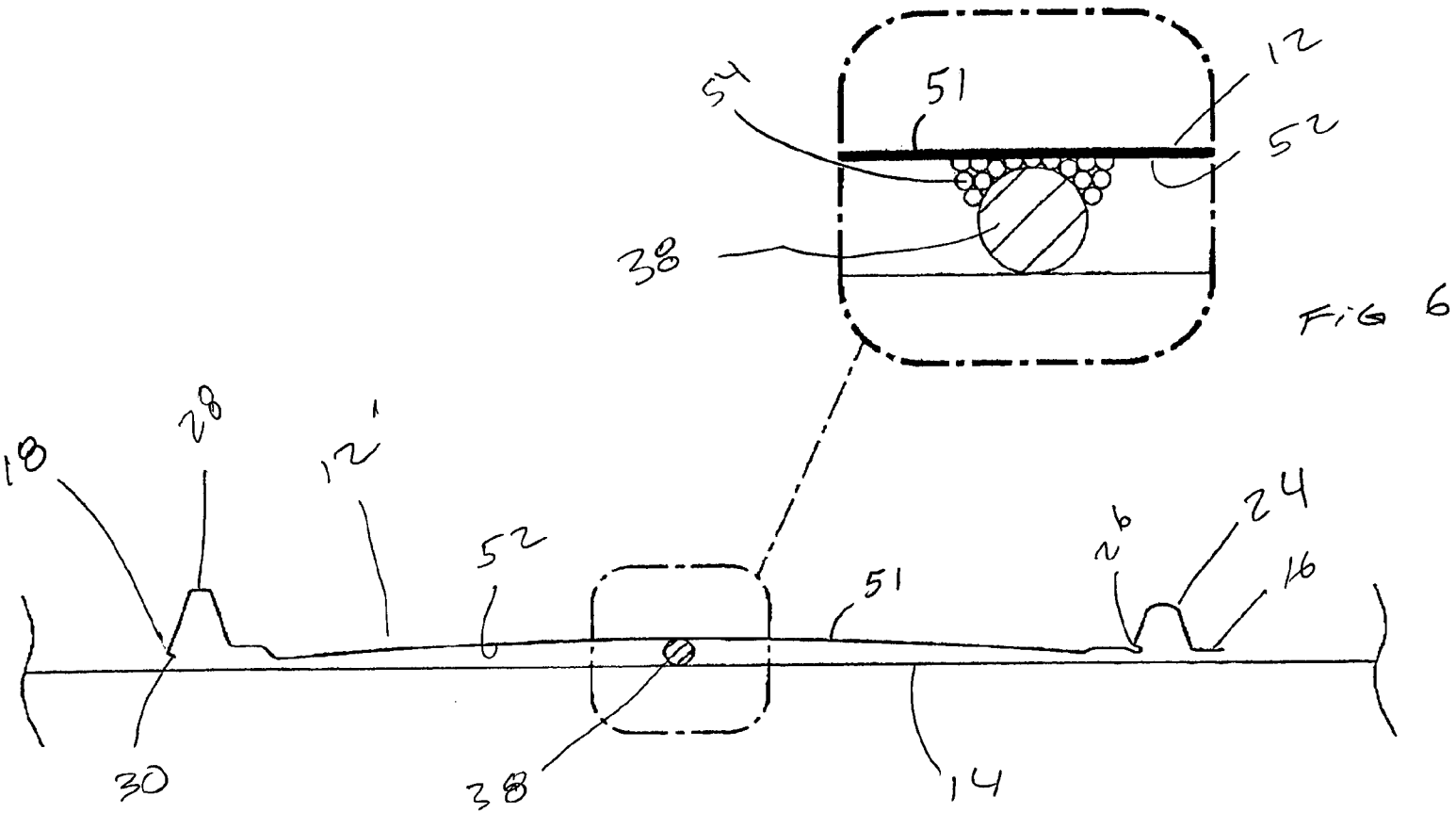
FIG. 5 is a view of a single metal panel, as seen from the same vantage point as FIG. 3.
FIG. 6 is an enlarged, detailed view of the dotted area of FIG. 5.

FIG. 1 is a schematic view of a portion of a roof 10 made in accordance with the present invention. In this embodiment, a plurality of roofing panels 12 are assembled together and installed on a roof 10. Each of the panels 12 defines two long edges 16, 18, (See also FIG. 5) and two short edges 20, 22. Referring to FIG. 5, adjacent the first long edge 16, a right edge rib 24 extends from the top short edge 20 to the bottom short edge 22, and this rib 24 defines a notch 26, which also extends the length of the panel 12. A left edge rib 28 is adjacent the second long edge 18 and likewise extends from the top short edge 20 to the bottom short edge 22. This rib 28 defines a projection 30, which also extends the length of the panel 12 and which is designed to be received in the notch 26 at the right edge 16 of an identical adjoining panel 12 when the rib 28 of this panel 12 fits over the rib 24 of the adjoining panel 12 to lock the two adjoining panels 12 together in a water tight assembly, as is well known in the industry.

Figure 2:
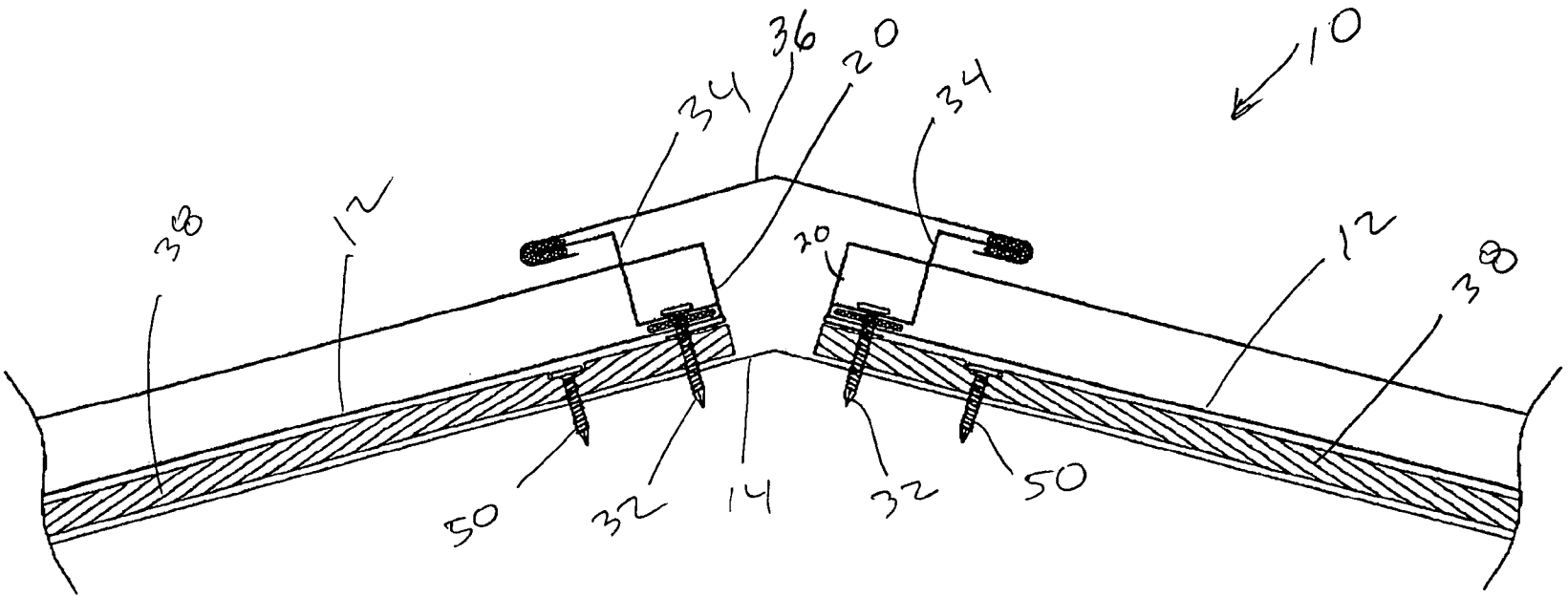
FIG. 2 is a broken away section view along line 2-2 of FIG. 1.

Referring to FIG. 2, the roof 10 includes a substrate 14 (such as plywood) onto which the metal panels 12 are secured via fasteners 32, such as nails or screws, at their top edges 20. These fasteners 32 may also be used to secure "Z" brackets 34 which hold the cap 36 in a water tight arrangement which protects the apex of the roof 10, as is also well known in the industry.

Figure 3:
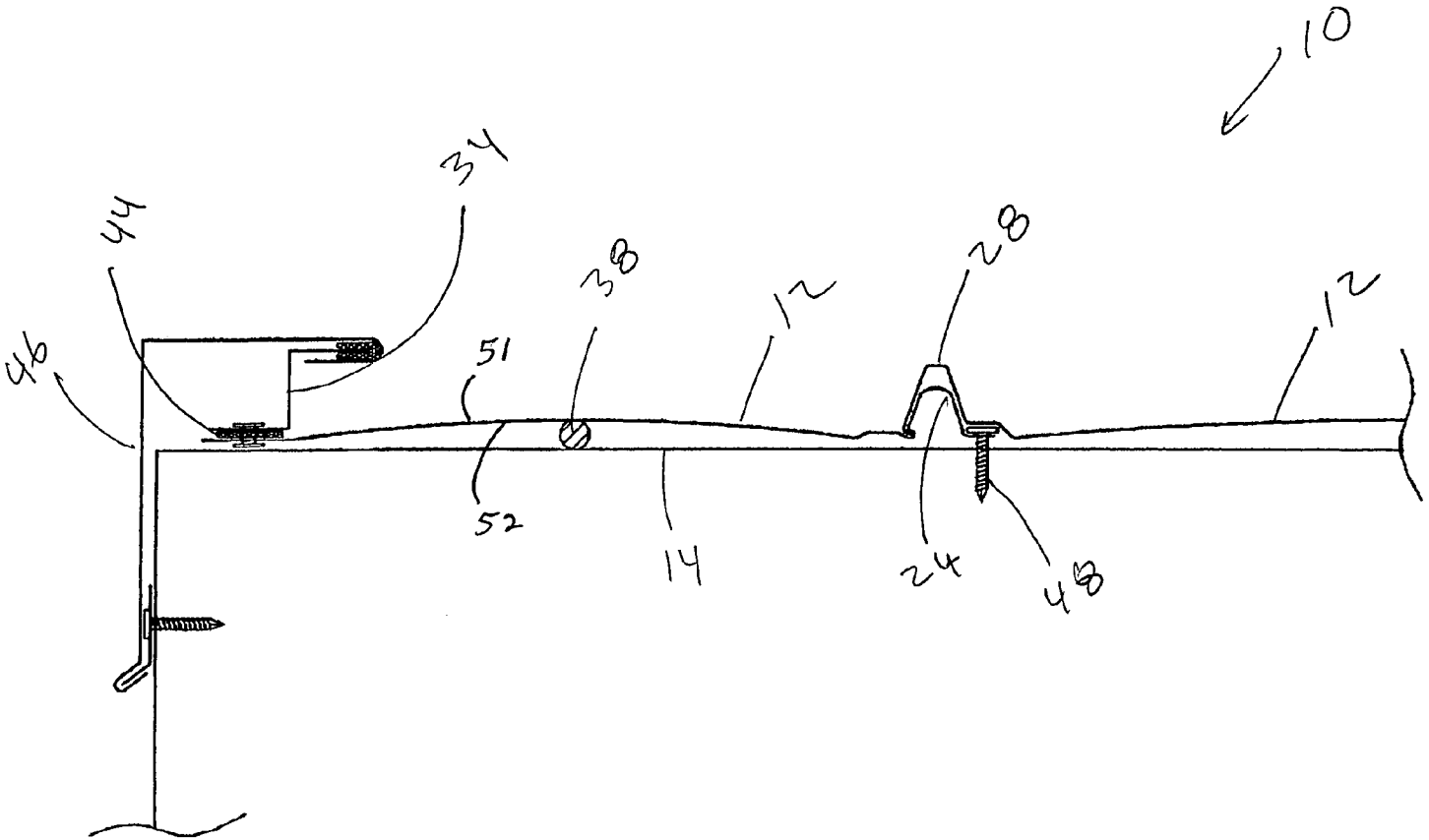
FIG. 3 is a broken away section view along the left-most end of the roof, schematically shown as being along line 3-3 of FIG. 1.
Figure 4:
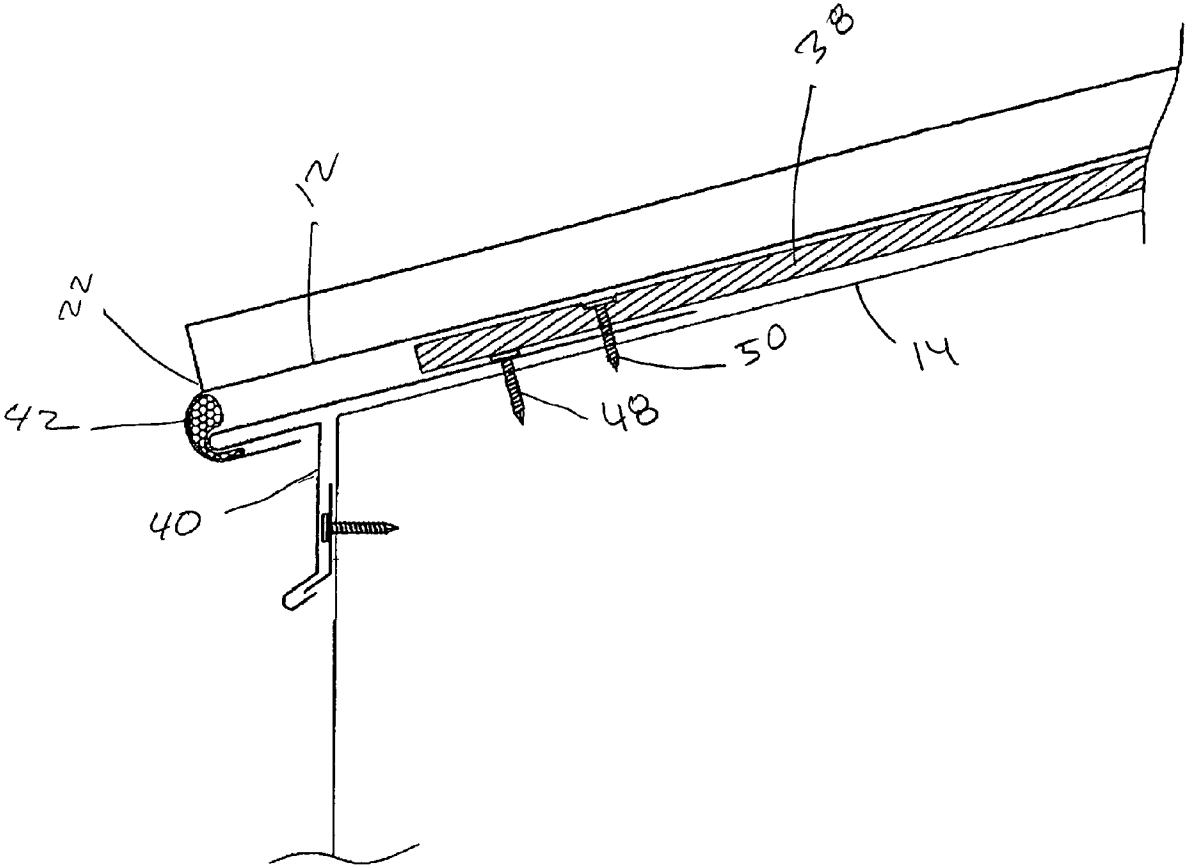
FIG. 4 is a broken away section view along line 4-4 of FIG. 1.

FIGS. 1-5 also show a spacer or support 38, which extends from the top edge 20 to the bottom edge 22 of its respective panel 12. As seen in FIG. 1, each of the panels 12 has such a spacer 38. Each spacer 38 is located approximately midway between the two long edges 16, 18 (See FIG. 5) of its panel 12. The spacer 38 may be continuous or may be made up of a plurality of discontinuous, aligned segments. FIG. 4 shows that the spacer 38 may terminate just short of the lower edge 22 of the panel 12 to allow the bottom edge 22 of the panel 12 to be bent around a drip edge 40, which is secured to the substrate 14 and lies between the panel 12 and the substrate 14. A sealant 42, such as caulking, may be added at the bend to help form a water tight seal. It is understood that the spacer 38 could extend all the way to the end of the panel 12, but terminating this spacer 38 short of the bottom edge as shown in FIG. 4 may facilitate making a tight bend around the drip edge 40.

Figure 5A:
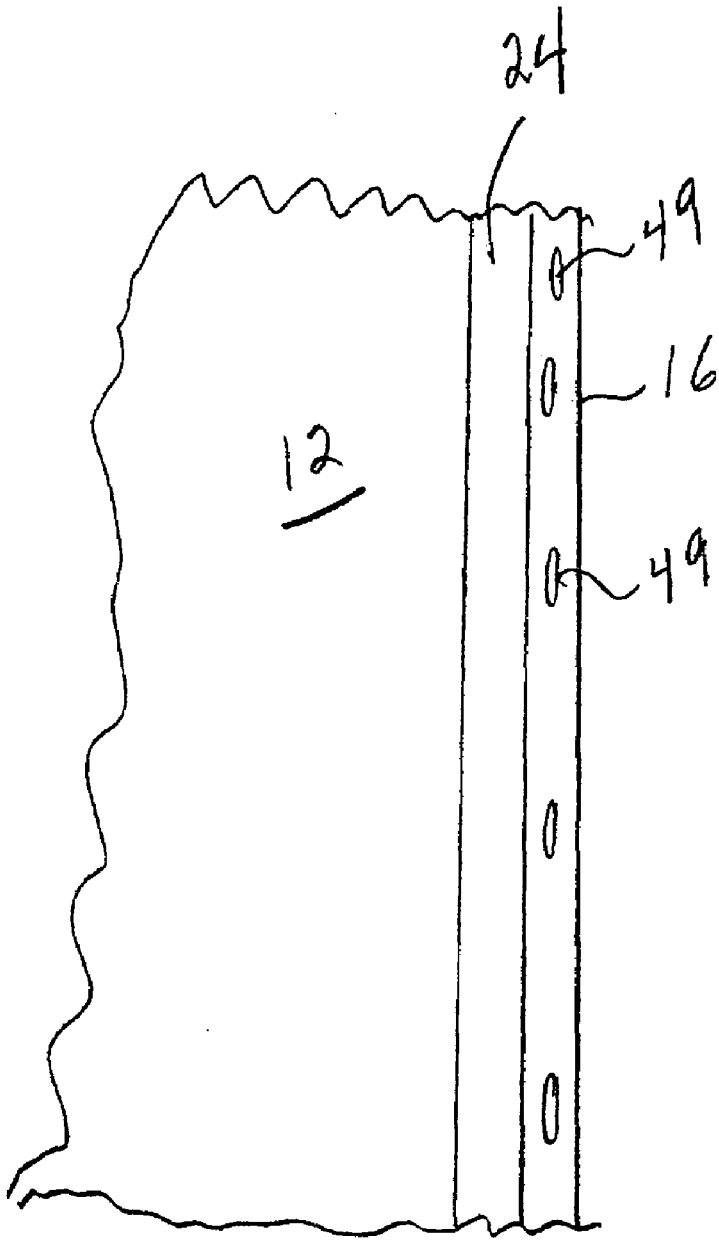
FIG. 5A is a broken away plan view of the right edge portion of the panel of FIG. 5.

FIG. 3 illustrates a typical installation of a roof 10 made in accordance with the present invention, particularly as it relates to finishing a longitudinal edge, such as the leftmost edge depicted in FIG. 3. A "Z" bracket 34 is attached to the left edge of the panel 12 (note that the left edge rib 28 has been cut off of this leftmost edge panel 12 to allow for the installation of the "Z" bracket 34). A seal 44 between the panel 12 and the "Z" bracket 34 prevents water migration past this joint. A drip edge 46 finishes off the edge, as is well known in the industry. Fasteners 48 are arranged at regular intervals along the right edges 16 of the panels 12, attaching the longitudinal edges 16 of the panels 12 to the substrate 14. The fasteners 48 go through the panels 12 via longitudinally aligned slotted openings 49 (see FIG. 5A) to allow for longitudinal displacement of the panels 12 due to normal thermal expansion and contraction.

In FIGS. 2 and 4, the spacer 38 is a rope-like material which is attached to the substrate 14 via fasteners 50, which extend at intervals through the spacer 38 and into the substrate 14. Once the spacers 38 are installed, the panels 12 are then installed over the substrate 14 and over the spacers 38, and the panels are secured to the substrate 14 via the fasteners 48, stretching or pre-stressing the panels 12 over the spacers 38 in order to induce a camber or slight outwardly convex bow on the substantially flat outer surface 51 of each panel 12 and a slightly concave bow on the substantially flat bottom surface 52 of each panel 12.

In FIGS. 5 and 6, the spacer 38 is shown to be attached to the bottom surface 52 of the panel 12' such that the spacer 38 need not be pre-installed on the substrate 14 prior to the installation of the panels 12'. In this case, the spacer 38 is a polypropylene rope that has been adhered to the underside of the panel 12' with an adhesive 54 prior to installing the panel 12'. In this particular embodiment, the panels 12' are twelve inches wide, and the polypropylene rope spacer 38 has a diameter of ⅜"-⅝". In testing, it was found that a diameter of ½" was very sufficient to prevent oil canning. Since the spacer 38 is in the center of the panel 12, it creates a slope of approximately one-half inch per each six inches of width of the panel 12, with the center of the panel 12 being approximately one-half inch higher than the edges, which lie at the level of the substrate 14.

It is advantageous for the spacer 38 to be made of a material that is flexible and compressible, preferably more compressible than the material of the panels 12, 12' and also more compressible than the substrate 14. Then, during installation of the roof 10 or during follow-up maintenance, should somebody walk on the roof panels 12, 12', the spacer 38 will compress and "give" a little, preventing unwanted kinking of the panels 12, 12', and then it will return to its original shape, again providing a camber or prestress to the panel.

The spacer 38 may be adhered to the rear face 52 of the panel 12, 12' by the installer prior to installation, or it may be a part of the original product made by the manufacturer. The spacer 38, being a separate member from the rest of the panel 12, 12', does not require a deviation from the smooth outer surface 51 of the panel 12, 12' as would be required by an extruded rib. While a polypropylene rope was used in this example, other types of spacers 38 may be used. For example, the spacer 38 may be a foam bead that is adhered to the rear face 52 of the panel 12, 12'. While the spacer 38 is continuous, the spacer could be made up of a plurality of discrete, substantially longitudinally aligned members that would provide the same effect. While the panels 12, 12' shown here have been described as roofing panels, the same procedure and construction would be used for metal wall panels, with the same result.

It will be obvious to those skilled in the art that modifications may be made to the embodiments described above without departing from the scope of the present invention.

What is claimed is:

1. A panel system for covering an exterior portion of a building, comprising:

an elongated, substantially flat sheet of metal defining a top surface, a bottom surface, and at least two opposed short edges and two opposed long edges; and an elongated spacer defining a thickness, said spacer being aligned substantially midway between said two long edges, lying against said bottom surface, and extending substantially the full length of said long edges, wherein, when said sheet of metal is installed over a flat substrate, with said long edges adjacent the surface of the substrate, said elongated spacer causes said sheet of metal to deflect away from the substrate to form a camber on said sheet of metal, making said bottom surface slightly concave and said top surface slightly convex.

2. The panel for covering an exterior portion of a building, as recited in claim 1, wherein said spacer is made of a material that is more compressible than said sheet of metal.

3. The panel for covering an exterior portion of a building, as recited in claim 1, wherein said substantially flat sheet of metal includes left and right ribs adjacent said long edges, said left rib being designed to nest with the right rib of an identical adjacent sheet.

4. The panel for covering an exterior portion of a building, as recited in claim 1, wherein said spacer is a rope material.

5. The panel for covering an exterior portion of a building, as recited in claim 1, wherein said spacer is secured to said bottom surface of said sheet of metal.

6. The panel for covering an exterior portion of a building as recited in claim 1, wherein said spacer has a diameter of between ⅜ and ⅝ of an inch.

7. The panel for covering an exterior portion of a building as recited in claim 1, wherein said spacer includes a plurality of discontinuous aligned segments.

8. The panel for covering an exterior portion of a building as recited in claim 1, wherein said spacer is continuous.

9. A method for installing a panel system to cover a substrate on an exterior portion of a building, comprising the steps of:

placing a spacer over the substrate;

placing a sheet of metal, defining a top surface, a bottom surface, and left and right edges over said spacer and over said substrate; and securing said sheet of metal to said substrate, such that said spacer causes said sheet of metal to deflect outwardly, away from the substrate, giving the sheet of metal a camber so that it defines a concave inner surface facing toward the substrate and a convex outer surface facing away from the substrate.

10. The method for installing a panel to cover a substrate on an exterior portion of a building as recited in claim 9, wherein said sheet of metal defines at least two long edges and said spacer is aligned substantially midway between said two long edges.

11. The method for installing a panel to cover a substrate on an exterior portion of a building as recited in claim 10, wherein said spacer is made of a material that is more compressible than said sheet of metal.

12. The method for installing a panel to cover a substrate on an exterior portion of a building as recited in claim 11, wherein said spacer has a diameter of between ⅜ and ⅝ of an inch.

13. The method for installing a panel to cover a substrate on an exterior portion of a building as recited in claim 10, including the step of securing said spacer to said bottom surface of said sheet of metal prior to installing said sheet of metal on said substrate.

* * * * *